US005679236A

United States Patent [19]

Pöschl

[11] Patent Number: 5,679,236

[45] Date of Patent: Oct. 21, 1997

[54] METHOD AND APPARATUS FOR THE PRODUCTION OF A FUEL MIXTURE

[75] Inventor: Günter Pöschl, Schwaikheim, Germany

[73] Assignee: PPV Verwaltungs AG, Zurich, Switzerland

[21] Appl. No.: 586,798

[22] PCT Filed: Aug. 4, 1994

[86] PCT No.: PCT/EP94/02592

§ 371 Date: Feb. 1, 1996

§ 102(e) Date: Feb. 1, 1996

[87] PCT Pub. No.: WO95/04590

PCT Pub. Date: Feb. 16, 1995

[30] Foreign Application Priority Data

Aug. 5, 1993 [DE] Germany ..... 43 26 360.7

[51] Int. Cl.[6] ..... C25B 1/02; C25B 1/12; C25C 9/00

[52] U.S. Cl. ..... 205/351; 205/628; 204/270; 204/277; 204/278; 204/292; 44/301

[58] Field of Search ..... 204/157.42, 157.62, 204/222, 277–278, 270, 292; 205/628, 351; 44/301, 451

[56] References Cited

U.S. PATENT DOCUMENTS

| | | | |
|---|---|---|---|
| 4,116,610 | 9/1978 | Berthiaume | 44/301 X |
| 4,218,221 | 8/1980 | Cottell | 44/301 |
| 4,276,131 | 6/1981 | Feuerman | 205/628 X |
| 4,410,333 | 10/1983 | Fujimoto | 44/451 |
| 4,599,459 | 7/1986 | Hirose | 204/157.62 |
| 5,176,809 | 1/1993 | Simuni | 204/277 X |

FOREIGN PATENT DOCUMENTS

| | | |
|---|---|---|
| 0 333 664 A2 | 9/1989 | European Pat. Off. . |
| 0 495 506 A3 | 7/1992 | European Pat. Off. . |
| 41 07 708 A1 | 9/1992 | Germany . |
| 1268-195-A | 11/1986 | U.S.S.R. . |
| 1690828-A1 | 11/1991 | U.S.S.R. . |
| WO79/00525 | 1/1978 | WIPO . |

*Primary Examiner*—Donald R. Valentine

*Attorney, Agent, or Firm*—Panitch Schwarze Jacobs & Nadel, P.C.

[57] ABSTRACT

A fuel mixture combusting virtually free of pollutants and, in addition, requiring only very small quantities of combustible hydrocarbons is produced by introducing liquid fuel, low-nitrogen air and water into a chamber (9) provided with at least one ultrasonic oscillator (7); by decomposing the fuel introduced and at least partially decomposing the water by cavitation; by dispersing the water and the air in the decomposed fuel; and by at least partially electrolytically decomposing the water. The fuel mixture has a foam-like consistency, is very easily combustible and can be stored for a longer time.

19 Claims, 2 Drawing Sheets

METHOD AND APPARATUS FOR THE PRODUCTION OF A FUEL MIXTURE

TECHNICAL FIELD

This invention refers to a method, an apparatus and to a fuel mixture produced according to the method, as defined in the preambles of claims 1, 7, 19, 20 and 24, respectively.

BACKGROUND ART

A method and an apparatus of this type are already known from EP 0 495 506 A3 and DE 41 01 303 A1 of the applicant. Here liquid fuel and preferably low-nitrogen air and water are introduced into a chamber. At least one ultrasonic oscillator is disposed in this chamber such that the fuel fed into it surrounds the oscillator on all sides. Furthermore, a cavitation element in the form of a discus-shaped disk caused to rotate in operation, is disposed in this chamber. On actuation of the oscillator and the cavitation element and with the introduction of air and water into the chamber with at least the same pressure as the liquid fuel, the low-nitrogen air is dissolved in the fuel and the water introduced is at least partially decomposed into its component parts and dispersed in the fuel, forming a mixture of a foam-like consistency. Since here the components of this mixture are very thoroughly dispersed, a virtually complete combustion of the mixture is possible; i.e. pollutants are hardly detectable in the combustion products. This is particularly true for nitrogen oxides, carbon monoxide and noncombusted hydrocarbons such as soot.

According to the assumptions and previous research findings of the inventor, the starting materials introduced into the chamber are thereby decomposed and dissolved in one another as follows: The water introduced is decomposed by ultrasound and cavitation into the components hydrogen, oxygen, $H_2O$, $H_2O_2$, as well as radicals of hydrogen, oxygen and OH. Hydrogen, oxygen and their radicals, as well as the $H_2O_2$ lead to the cracking of the hydrocarbon chains of the fuel. Through the cracking of the hydrocarbon chains the radicals of hydrogen, oxygen and OH are valently bonded to cracked hydrocarbon chains. Remaining unbonded radicals, however, are highly reactive and can be very quickly reconverted to $H_2O$. The cavitation and the action of ultrasound on the fuel likewise effect a split-up of the hydrocarbon chains. In the mixture produced, molecular hydrogen and oxygen are further present and are also bonded to hydrocarbon chains. The molecular hydrogen and oxygen are embedded in extremely small quantities in oil droplets by the cavitation and are surrounded by a fine oil film.

What is in need of improvement in this known method is that after the cracking a relatively large amount of undecomposed $H_2O$ and $H_2O_2$ and many unbonded radicals are still present; moreover, the $H_2O$ is very undesirable due to its radical-capturing property. To be sure, the $H_2O_2$ present also decomposes hydrocarbon chains; however, it can also be very easily converted to acid, for instance $H_2SO_4$, for which reason it is likewise undesirable. The hydrogen and oxygen molecules not bonded to hydrocarbon chains, i.e. not used for cracking, also recombine very easily back to $H_2O$, for which reason the mixture produced is very unstable and separates into water and carbon mixtures within a few hours.

Furthermore, the production of the mixture by means of the known method requires a large expenditure of time and energy, which should be reduced. In addition, the complete decomposition of several substances is not possible, so that these substances participate no further in the later combustion and merely hinder the reaction and diminish the efficiency. In the combustion of the known mixture, however, it is particularly advantageous that the hydrocarbon chains are very highly decomposed and the oxygen required for the combustion is likewise dissolved in the mixture in a very highly decomposed state, so that a previously unattained complete combustion and thus a previously unattained high efficiency can be achieved.

DISCLOSURE OF INVENTION

The object of the invention is to improve the known method according to the preamble of claim 1 in such a way that, on the one hand, the mixture produced can be made with less energy and substantially more quickly than before and that, on the other hand, the mixture produced has a longer life and is more stable; furthermore, an apparatus for carrying out the method is to be created and a new, more stable fuel mixture is to be provided.

This object is achieved according to the invention by the steps and/or features given in claims 1, 7 and 19.

In the method according to the invention, the water introduced in the production of the mixture is additionally at least partially decomposed electrolytically in the chamber. The water is thus substantially more completely decomposed and is furthermore primarily only decomposed into oxygen and hydrogen and their radicals, which crack the hydrocarbon chains. Thus by means of the method according to the invention larger quantities of hydrogen and oxygen and their radicals are formed more quickly for the decomposition of the hydrocarbon chains. In addition, almost no further $H_2O$ and $H_2O_2$ are present in the fuel mixture produced according to the invention, which mixture contains less fuel and more water with equal caloric output and equal total quantity than does a corresponding known fuel mixture. It has been shown that the fuel mixture produced in this manner is substantially longer lived and more stable than the known one.

The fuel mixture produced with the apparatus according to the invention can be produced directly in vehicles, for instance, and does not require large and heavy energy tanks such as those necessary for alternative energy sources in motor vehicles, such as hydrogen or electric energy. The total energy balance is therefore better in a vehicle provided with the apparatus according to the invention or in a vehicle operated with the fuel according to the invention than in a vehicle operated with an alternative energy source. In addition, except for $CO_2$, there is evidently virtually no emission of pollutants. At any rate, in the test series conducted to date, no recognisable emission of pollutants could be measured in the apparatus according to the invention. The effect of the fuel mixture according to the invention in controlled combustion processes is that $NO_x$ emissions no longer occur. Furthermore, the formation of $CO_2$ in the combustion process is almost totally ruled out. The result of this is a large proportion of oxygen, the explanation for which is that the carbon contained in the combustible hydrocarbon is completely converted to energy during the combustion. Due to the small proportion of carbon in this hydrocarbon mixture, it is impossible for elementary carbon (such as soot) to remain after combustion. In tests an oxygen content of 24% by volume has been measured in the exhaust.

Advantageous embodiments of the method according to the invention form the subject matters of the subclaims.

In the embodiment of the invention according to claim 3, at least one catalyst is provided in the electrolysis, lowering the power consumption and accelerating the electrolysis itself.

In the embodiment of the invention according to claim 4, electrodes of catalytic material are used in the electrolysis.

The method according to the invention is particularly advantageous in the embodiment of the invention according to claim 5. In this embodiment the water already undergoes a preliminary electrolytic decomposition prior to being fed into the chamber, whereby less energy is required in decomposing the water within the chamber and the decomposition is more complete and more rapid.

In the embodiment of the invention according to claim 6 the partial decomposition takes place in the presence of a catalyst.

An apparatus for carrying out the method forms the subject matters of claims 7 to 18.

The fuel mixture produced in accordance with the invention according to claim 19 has proven to be stable over a period of several days.

A fuel having a quantitative composition similar to the fuel mixture according to claims 20 and 24 is already known from the DE 30 01 308 A1 and the EP 0 301 766 A1. However, in the prior art a sort of fuel mist is produced by ultrasound, whereas in the fuel mixture produced according to the invention the low-nitrogen air is dissolved in the fuel. According to the DE 30 01 308 A1, a fuel mixture of fuel and water is produced. The air is only subsequently admitted during atomisation of the mixture and is therefore not present in solution in the fuel. As compared with the fuel mixture according to EP 0 301 766 A1, the fuel mixture produced according to the invention possesses a substantially higher water content and a correspondingly lower fuel content.

BRIEF DESCRIPTION OF DRAWINGS

Embodiments of the invention are explained below in more detail on the basis of the drawings.

BEST MODE OF CARRYING OUT THE INVENTION

Figure 1:
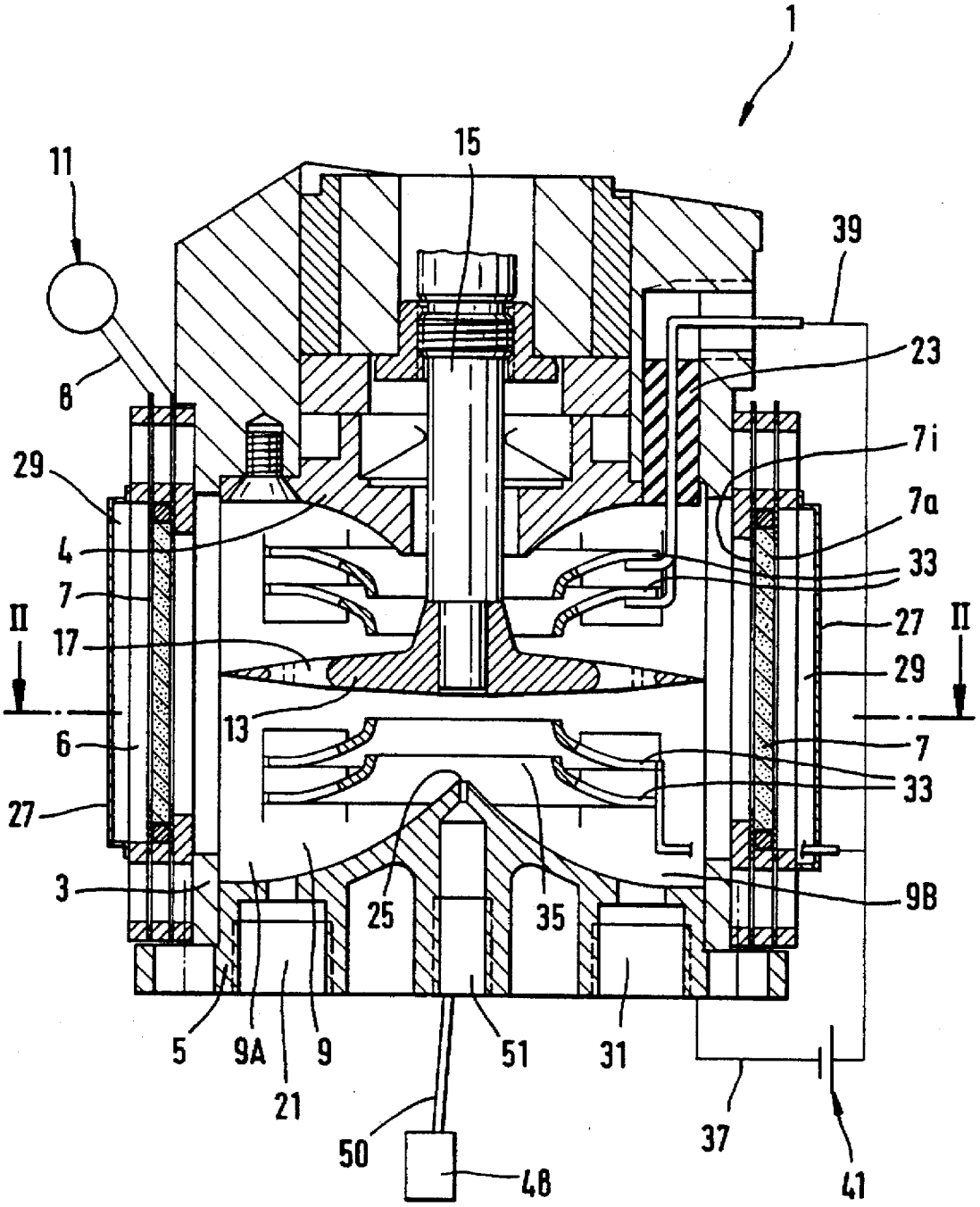
FIG. 1 shows a longitudinal sectional view of the apparatus according to the invention for the production of a fuel mixture.

FIG. 1 shows an apparatus for the production of a fuel mixture, including a cube-shaped, closed container 1 having an upper outer wall 4, a lower outer wall 5 and four contiguous outer side walls 3, delimiting an inner chamber 9 of the container 1. Each of the outer side walls 3 possesses a large circular bore 6, with an ultrasonic oscillator 7 inserted into each respective bore 6.

The cross-sectional form of the container 1 is immaterial. The important thing here is merely that the ultrasonic oscillators 7 have as large an effective area as possible directed toward the interior of the chamber 9, there being an advantageous effect if the ultrasonic oscillators are arranged in pairs facing one another in the chamber 9.

The ultrasonic oscillators 7 consist of ferroelectric material such as piezoceramics and are connected via lines 8 to an ultrasonic generator 11. Ultrasonic generators for ultrasonic oscillators 7 are known. Their construction is described, for example, in the EP-A-0 340 470 and in the DE-OS 36 25 149. In the present context it is merely important that the generator circuit be constructed such that different frequencies can be impressed on the ultrasonic oscillator 7. The frequencies depend on the geometry of the ultrasonic oscillator 7, on the viscosity of the liquid fuel, and finally on the desired selection of air components—each of the gas components ordinarily present in air has a different optimum frequency at which they are soluble in liquids.

In the interior of the chamber 9 a nickel-plated discus-shaped cavitation element 13 of platinum is provided, said cavitation element 13 being connected via a drive shaft 15 to a rotary drive not shown and having several axial through bores 17. Furthermore, in the chamber 9, above and below the cavitation element 13 star-shaped platinum-coated anodes 33 are provided centrically to the cavitation element 13, each anode 33 having a centric opening 35. The star-shaped anodes 33 communicate with a direct current source 41 via lines 39 electrically insulated in turn against the outer walls 3, 4 and 5 of the container 1 by an insulation element 23. The upper and lower outer walls 4 and 5 are also connected to the direct current source 41 via lines 37 (the corresponding line to the outer wall 4 is not shown). The upper and lower outer walls 4 and 5, which incidentally are made of nickel, thus form a cathode. The lower outer wall 5 tapers conically and centrically toward the interior of the chamber 9 and possesses a centric chamber orifice 25 for the intake of water and low-nitrogen air. The upper outer wall 4 also tapers conically and centrically toward the interior of the chamber 9, so that together with the lower outer wall 5, seen in cross section, a left chamber half 9A and a right chamber half 9B that are parabolic in shape are formed. The ultrasonic oscillations created by the ultrasonic oscillators 7 in operation are concentrated in focal points of the paraboloids by reflections on the inwardly conically and centrically tapering outer walls 4 and 5. Very hot zones, so-called hot spots, with up to 5000 ° C. come into being at these focal points. In addition, the lower outer wall 5 has an eccentrically arranged chamber orifice 21 for the intake of fuel and a likewise eccentrically arranged outlet orifice 31 for the exit of the fuel mixture produced. The chamber orifice 25 for water and low-nitrogen air opens toward the bottom into a threaded bore 51.

As will be explained in detail below, the fuel introduced comes into contact with at least one, namely an inwardly directed, effective area **7*i* of the ultrasonic oscillators 7. In addition, however, it is advantageous for the outwardly directed effective area 7*a* of the ultrasonic oscillators 7, which generates oscillations in the same manner, likewise to be used. For this, outwardly convex covers 27 are additionally fastened to the outer side of the container 1 such that between each cover 27 and the associated ultrasonic oscillator 7 one outer chamber 29 each is formed, to which for instance the fuel, water or low-nitrogen air to be fed into the chamber 9** can be supplied via lines not shown.

Figure 2:
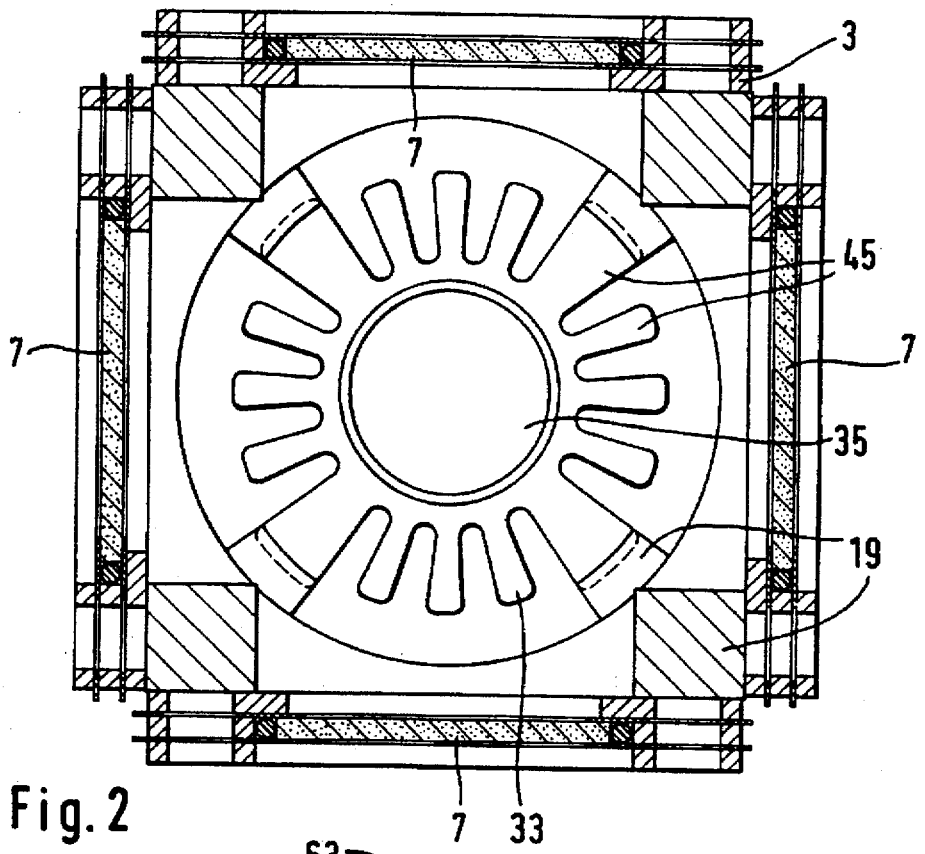
FIG. 2 shows a cross-sectional view along line 2—2 in FIG. 1.

In FIG. 2 the outer side walls 3 with the ultrasonic oscillators 7 inserted therein and an anode 33 can be seen. The anode 33 has numerous fingers 45 pointed away from its centric opening 35. The anodes 33 are fixed in the chamber 9 by four supports 19 made of insulating material fastened to the corners of the chamber 9, the anodes 33 being held in groove-shaped recesses in said supports 19.

Figure 3:
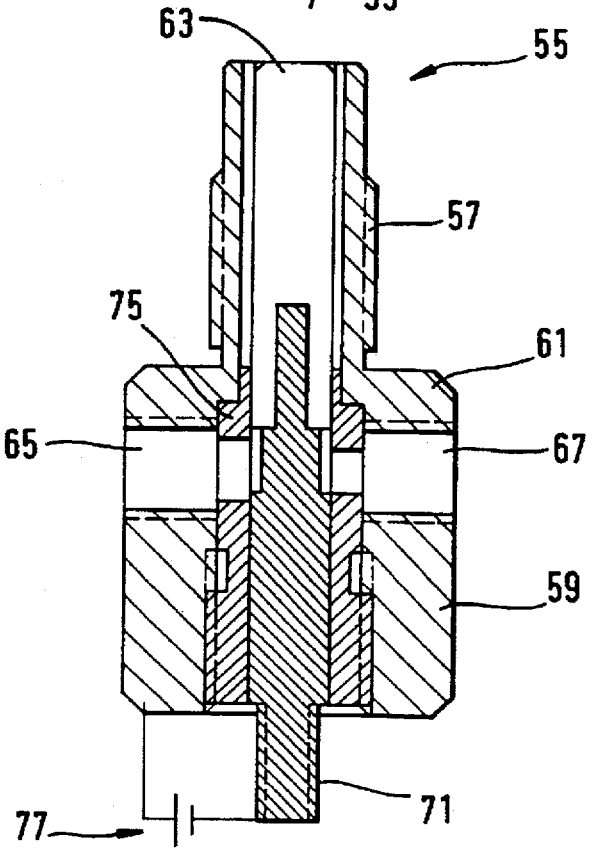
FIG. 3 shows a longitudinal sectional view through a partial decomposition nozzle.

FIG. 3 shows a partial decomposition nozzle 55 screwed with an upper threaded section 57 into the threaded bore 51 shown in FIG. 1. The partial decomposition nozzle 55 substantially comprises three parts, namely an outer nickel jacket forming a cathode 61, an insulating ring 75 and a pin-shaped platinum-coated anode 71. The cathode 61 in turn possesses a lower cylindrical section 59 in addition to the threaded section 57 and has a centric inner through bore 63, with a radial air inlet bore 65 and a radial water inlet bore 67 opening into said bore 63. The insulating ring 75 with the pin-shaped anode 71 disposed in its interior is pressed into the portion of the inner bore 63 extending into the lower cylindrical section 59. The anode 71 narrows off in steps toward the threaded section 57. The cathode 61 and the anode 71 are connected via lines to a second direct current source 77.

The mode of operation of the apparatus for producing a fuel mixture will now be explained in more detail on the basis of the drawings. Liquid fuel such as diesel oil or oil produced from organic material, such as rape oil, is fed into the chamber 9 via the chamber orifice 21. In this connection it is not necessary to interchange esters of the oils won from vegetable raw materials, as has been usual with such fuels up to now. The fuel introduced flows toward the cavitation element 13, which rotates at a high peripheral speed, and flows through the bores 17, to then flow with high speed radially outwardly toward the ultrasonic oscillators 7. At the peripheral edge of the cavitation element 13 so-called cavitation phenomena occur, leading to the cracking of the fuel introduced, i.e. it is so greatly decomposed that the long hydrocarbon chains contained in the fuel are split up into short chains. The ultrasonic oscillations in the chamber 9, created by the ultrasonic oscillators 7, also lead to the further cracking of the hydrocarbon chains, as is likewise the case with the oxygen, hydrogen, OH and $H_2O_2$ radicals located in the chamber.

If the outer chambers 29 are also used, the fuel will first flow through the outer chambers 29 before flowing into the chamber 9. In every outer chamber 29 the ultrasonic oscillations generated by the outwardly directed effective area 7*a* already lead to the cracking of some hydrocarbon chains, resulting in a partial preliminary decomposition of the fuel in the outer chambers 29. The fuel coming into contact with the outwardly directed effective area 7*a* serves additionally to cool the ultrasonic oscillator 7, which heats up during operation. Of course, it is also possible to feed a fuel mixture already produced in the chamber 9 subsequently into the outer chambers 29 or, by feeding water into the outer chambers 29, to achieve a partial decomposition of the water prior to its introduction into the chamber 9. Also, embodiments of the chamber 9 are conceivable in which the ultrasonic oscillator 7 freely oscillates and the fuel can flow around both sides; or yet other embodiments are conceivable in which a part of the fuel gets into the outer chambers 29 via lines not shown and reaches the outwardly directed effective areas 7*a* of the ultrasonic oscillators 7 (the efficiency and function of which are in turn improved by the good electrically insulating property of the fuel supplied) and another portion of the fuel is fed directly into the chamber 9. The proportion of the water fed into the chamber 9 amounts to approximately 30 to 50 mol. % or up to 95% by volume of the fuel quantity.

Disposed outside the chamber 9 is a compressor 48 that compresses the air and forces it under high pressure, for example 2.5 bars, through a packed zeolite bed not shown. In the packed zeolite bed, in which the air nitrogen is adsorbed, the proportion of oxygen is increased to 60 to 92%. This high-oxygen and low-nitrogen air is fed to the chamber 9 via the air feed line 50 designed as a correspondingly dimensioned capillary tube. The integration of the compressor 48 into the apparatus shown in FIG. 1 has the advantage that the quantity of air conveyed increases or diminishes from the start depending on the rotational speed. A rotary drive not shown is arranged in such a way that it drives the cavitation element 13 and a shaft of the compressor 48.

Low-nitrogen air and water then flow into the partial decomposition nozzle 55 via the radial air inlet bore 65 and the radial water inlet bore 67, respectively, nearly simultaneously with the introduction of fuel into the chamber 9. The cathode 61 and the anode 71, to which a direct current is applied, electrolytically decompose the water at least partially mainly into oxygen, hydrogen, $H_2O_2$ and radicals thereof. The resulting mixture of undecomposed water, oxygen, hydrogen $H_2O_2$ and the radicals flows into the chamber 9 via the inner bore 63 and the chamber orifice 25 for air and water.

The undecomposed water introduced is decomposed into oxygen, hydrogen, $H_2O_2$ and radicals thereof by a) cavitation caused by the cavitation element 13, b) ultrasonic oscillations generated by the ultrasonic oscillators 7, c) an additional electrolysis within the chamber 9.

The cavitation element 13 thus performs several tasks: It supports the cracking of the long hydrocarbon chains to short chains. It partially decomposes water itself and, as will be explained in further detail later on, disperses in the fuel the products occurring in the decomposition of water, so that a homogenous fuel mixture comes into being. Since the cavitation element 13 is not additionally insulated against the upper outer wall 4 designed as a cathode, the cavitation element 13 itself acts as a cathode, so that during the electrolysis a greatly increased oxygen split-off can be observed at the cavitation element 13. In the apparatus according to the invention and in the method according to the invention more oxygen is produced than is necessary to saturate the cracked hydrocarbon chains. The remaining oxygen would lead to chemical oxidation products in the fuel mixture, which in turn would cause undesired reactions in the later combustion of the fuel mixture. This is avoided in that the oxygen produced is dispersed by the cavitation element 13; i.e. it is embedded in minute fuel bubbles. The ultrasonic oscillations in turn lead among other things to the tiny oxygen bubbles dispersed in the fuel being so greatly reduced in size that a type of matrix comprising fine films of fuel with short hydrocarbon chains and tiny oxygen and hydrogen bubbles embedded therein is formed. Finally, due to the bores 17, the rotating cavitation element 13 acts as a modulator in the ultrasonic field generated in the chamber 9, which modulator alters the frequency of the ultrasonic oscillations generated by the ultrasonic oscillators 7.

The electrolysis is executed inside the chamber 9 by an electrolysis device substantially comprising the anodes 33 and the outer walls 4 and 5 and the cavitation element 13 acting as a cathode. The water flowing in via the chamber orifice 25 flows through the centric openings 35 of the anodes 33 and for the most part further upward through the bores 17 in the cavitation element 13, where the water is then spun outwardly by the cavitation element 13. In the water as well as in the fuel introduced, cavitation phenomena appearing as tiny cavitation bubbles can also be detected at the peripheral edge of the cavitation element 13. The tiny cavitation bubbles appearing, which implode very quickly again, creating high pressure and high temperature, likewise cause the decomposition of the water and the cracking of the hydrocarbon chains. Although the water and the fuel could also be decomposed and dispersed in the chamber 9 without the electrolysis device, a larger quantity of radicals is formed through use of the electrolysis device, which in turn then contribute to the cracking of the hydrocarbon chains within a short time. In the cracking of the hydrocarbon chains it is decisive that hydrogen, oxygen or OH radicals be bonded to the cracked chains, in order for the cracked chains to remain stable and not to rebond themselves to form longer chains. The electrolysis device increases the quantity of radicals formed so greatly that this rebonding of the cracked hydrocarbon chains hardly occurs anymore.

All previously described physical and chemical phenomena in the chamber result in the formation of a fuel mixture having a foam-like consistency. In this fuel mixture the water introduced and split up and the air introduced are so finely diffused in the fuel that oxygen and hydrogen are dissolved in the fuel. Molecular hydrogen and oxygen appearing are also embedded in extremely small quantities in oil droplets by the cavitation and the ultrasonic oscillations, i.e. they are encompassed by a fine oil film that prevents the molecular hydrogen and oxygen from rebonding in a reaction of oxyhydrogen gas or to recombine to water. The fuel mixture produced in this way flows via the outlet orifice 31 into a tank or directly to a combustion chamber, where it combusts virtually free of pollutants. Mainly water and oxygen, and almost no $CO_2$ occur. No pollutants could be detected in prototypes of the apparatuses. No more non-combusted hydrocarbons appear in this combustion, since the hydrocarbon chains are very short and, furthermore, very much oxygen has already been dissolved in the fuel. Furthermore, in the combustion of the fuel mixture reactions of oxyhydrogen gas between molecular hydrogen and oxygen also take place. These reactions of oxyhydrogen gas increase the caloric output of the entire fuel mixture, which is so high that only approximately 1/10 of the otherwise usual quantity of hydrocarbon supplied is necessary for combustion processes.

With the partial electrolytic decomposition of the water, which is conducted with the electrolysis device and the partial decomposition nozzle, large quantities of water can be decomposed and radicals formed within an extremely short time. This can be still further increased by conducting the electrolysis in the presence of a catalyst. In the apparatus shown in the drawings the electrodes and the cavitation element 13 themselves are made of catalytic material, i.e. the anodes are coated with platinum and the cathodes consist of nickel.

In addition, however, it is also possible and particularly advantageous for the electrodes to be made of electrically conductive ceramics, preferably on a silicon carbide basis. The larger the outer surface of the catalytic material, the greater the catalytic effect. The outer surface can be considerably enlarged still further by sputtering catalytic material in clusters onto the electrically conductive ceramics or onto a metallic base material.

It has also been shown that the catalytic effect is very great if a different catalytic material is sputtered onto the same electrodes. In the apparatus shown, this catalytic material has been selected from among lanthanum, osmium, as well as rare earth and transition metals.

The catalysts also lead to a lower current reception of all electrodes, which for their part can have a smaller surface when catalysts are used.

In one embodiment 240 ml of high-oxygen and low-nitrogen air were dissolved in 100 ml of liquid fuel.

The fuel mixture formed had a concentration of up to 95% by volume water and up to 5% by volume oil (in the mol ratio oil:oxygen in air of 1:5). The inventor has determined that a combustible oil-water-oxygen mixture comprising up to 95% by volume water is producible with this method.

The fuel can be a hydrocarbon in the form of gas such as methane, propane, butane or the like dissolved in the water proportion of the fuel mixture, or it can also be an elementary carbon such as soot or coal dust, with the mol ratio of carbon:oxygen in air in the latter case being at least 1:8. In the first case, a gas mixture likewise virtually free of pollutants would be produced in the chamber 9.

As oil, besides mineral oil, biological oil such as rape oil, sunflower oil, soybean oil, eucalyptus oil, castor oil, train oil, etc. can be considered.

As alcohol, methanol, butanol or the like, or ether can be considered.

I claim:

1. A method for the production of a fuel mixture comprising the steps of:

a) introducing liquid fuel into a chamber provided with at least one ultrasonic oscillator, said oscillator being connected to an ultrasonic generator, until the fuel comes into contact with at least at one of the effective areas of the oscillator;

b) introducing air preferably in the form of low-nitrogen air and water into the chamber with at least the same pressure as the liquid fuel, wherein the proportion of water fed into the chamber amounts to approximately up to 95% by volume of the fuel quantity;

c) decomposing the introduced fuel and at least partially decomposing the water by cavitation, said cavitation being achieved by at least one of ultrasound and at least one mechanically rotating, cavitation-causing element, and d) dispersing the decomposed fuel and water, as well as the introduced air by actuating the oscillator characterized in that:

e) in the chamber the water is additionally partially decomposed electrolytically wherein a fuel mixture comprising liquid fuel and air is produced.

2. The method according to any of claim 1, characterized in that the water is partially electrolytically decomposed prior to being introduced into the chamber.

3. The method according to claim 2, characterized in that the partial electrolytic decomposition takes place in the presence of at least one catalyst.

4. A fuel mixture made in accordance with the method of claim 1, said fuel mixture comprising at least a liquid fuel and air, wherein the mixture contains a water proportion of up to 95% by volume, the air is a low-nitrogen air, the liquid fuel is an oil, preferably a biological oil and the air is dissolved in the liquid portion of the fuel mixture and characterized in that the mol ratio of oil:oxygen is at least 1:5.

5. The fuel mixture according to claim 4, characterized in that the oil is dissolved in the water portion.

6. A fuel mixture made, in accordance with the method of claim 1, characterized in that the mixture has a water proportion of up to 95% by volume, that the air is a low-nitrogen air, that the liquid fuel is carbon dispersed in the water portion, that the tool ratio of carbon:oxygen in air is at least 1:8, and that the air is dissolved in the liquid portion of the fuel mixture.

7. A fuel mixture made in accordance with the method of claim 1, said fuel mixture comprising at least a liquid fuel and air, wherein the mixture contains a water proportion of up to 95% by volume, the air is a low-nitrogen air, the liquid fuel is an alcohol and the air is dissolved in the liquid portion of the fuel mixture and characterized in that the mol ratio of alcohol:oxygen is at least 1:5.

8. An apparatus for production of a fuel mixture, said apparatus comprising:

a chamber provided with outer walls and being configured so that liquid fuel is capable of being introduced into said chamber;

at least one ultrasonic oscillator connected to an ultrasonic generator, said ultrasonic oscillator being associated with the chamber in such that said oscillator can freely oscillate and contact fuel introduced into the chamber with at least one effective area;

a rotatable cavitation element disposed in the chamber;

chamber orifices (21, 25) for introducing primarily low-nitrogen air, fuel and water into said chamber, the low-nitrogen air and water having at least the same pressure as the liquid fuel; and an electrolysis device having several electrodes including at least one anode and one cathode provided in the chamber.

9. The apparatus according to claim 8, characterized in that the electrolysis device is connected to a direct current source.

10. The apparatus according to claim 8, characterized in that at least one catalyst for a partial decomposition of water is provided in the chamber.

11. The apparatus according to any of claim 8, characterized in that the outer walls of the chamber are designed as electrodes.

12. The apparatus according to claim 8, characterized in that the cavitation element itself is designed as an electrode.

13. The apparatus according to claim 8, characterized in that several anodes and cathodes are arranged alternately in the chamber.

14. The apparatus according to claim 8, characterized in that the chamber orifice for the introduction of water is provided with an additional electrolysis device with several electrodes comprising at least one anode and one cathode.

15. The apparatus according to claim 14, characterized in that at least one catalyst is provided in the additional electrolysis device.

16. The apparatus according to claims 8, characterized in that at least some of the electrodes or parts of the electrodes themselves are made of catalytic material.

17. The apparatus according to claim 16, characterized in that the anodes are platinum anodes and the cathodes are nickel cathodes.

18. The apparatus according to claim 16, characterized in that the electrodes are made of electrically conductive ceramics, preferably on a silicon carbide basis, and they have catalytic material sputtered in clusters on their outer surface.

19. The apparatus according to claim 18, characterized in that different catalytic material is sputtered onto the same electrodes.

* * * * *